US011264196B1

(12) United States Patent
Tazarine et al.

(10) Patent No.: US 11,264,196 B1
(45) Date of Patent: Mar. 1, 2022

(54) FUSIBLE LINK, CIRCUIT ARRANGEMENT AND MOTOR VEHICLE COMPRISING SAID CIRCUIT ARRANGEMENT

(71) Applicant: Auto-Kabel Management GmbH, Hausen i.W. (DE)

(72) Inventors: Wacim Tazarine, Erkelenz (DE); David Cacciatore, Kempen (DE)

(73) Assignee: Auto-Kabel Management GmbH, Hausen i.W. (DE)

( * ) Notice: Subject to any disclaimer, the term of this patent is extended or adjusted under 35 U.S.C. 154(b) by 0 days.

(21) Appl. No.: 17/425,232

(22) PCT Filed: Jan. 9, 2020

(86) PCT No.: PCT/EP2020/050364
§ 371 (c)(1),
(2) Date: Jul. 22, 2021

(87) PCT Pub. No.: WO2020/160866
PCT Pub. Date: Aug. 13, 2020

(30) Foreign Application Priority Data

Feb. 5, 2019 (DE) ..... 10 2019 102 792.6

(51) Int. Cl.
*H01H 85/02* (2006.01)
*H01H 85/20* (2006.01)

(52) U.S. Cl.
CPC ..... *H01H 85/0241* (2013.01); *H01H 85/205* (2013.01); *H01H 2085/0275* (2013.01); *H01H 2085/0283* (2013.01)

(58) Field of Classification Search
CPC .. H01H 85/0241; H01H 85/205; H01H 85/30; H01H 2085/0275; H01H 2085/0283
See application file for complete search history.

(56) References Cited

U.S. PATENT DOCUMENTS 5,598,138 A 1/1997 Jaronczyk, Jr.
6,141,202 A * 10/2000 Maeckel ..... H01H 85/46 361/187
2002/0008951 A1 1/2002 Ohta et al.
2002/0047770 A1 4/2002 Scoggin et al.
2007/0257807 A1 11/2007 Darr
2009/0115401 A1 5/2009 Hoch et al.
(Continued)

FOREIGN PATENT DOCUMENTS

DE 92 09 177 U1 11/1993
DE 10 2007 044427 A1 3/2009
(Continued)

OTHER PUBLICATIONS

Korean Intellectual Property Office, Office Action, Application No. 10-2021-7024825, dated Sep. 2, 2021, 8 pages (English translation).
(Continued)

*Primary Examiner* — Jacob R Crum
(74) *Attorney, Agent, or Firm* — Sunstein LLP

(57) ABSTRACT

Melting fuse with a melting wire arranged between a first and a second terminal, characterized in that a connecting pin is arranged on each of the first and second terminals, a printed circuit board is placed on the connection pin, and at least one integrated circuit is arranged on the printed circuit board on the side facing away from the melting wire.

12 Claims, 2 Drawing Sheets

(56) References Cited

U.S. PATENT DOCUMENTS

| | | | | |
|---|---|---|---|---|
| 2009/0128094 | A1* | 5/2009 | Okuto | H02J 7/0031 320/134 |
| 2016/0268820 | A1* | 9/2016 | Ono | B60L 53/22 |
| 2016/0324002 | A1* | 11/2016 | Tazarine | H05K 1/181 |
| 2017/0094790 | A1* | 3/2017 | Tazarine | H05K 1/056 |
| 2017/0250549 | A1* | 8/2017 | Jin | H02H 7/18 |
| 2018/0047670 | A1* | 2/2018 | Zhou | H01L 23/5256 |
| 2019/0027333 | A1* | 1/2019 | Zhou | H01H 85/0095 |
| 2019/0189382 | A1* | 6/2019 | Holland | H01H 85/046 |

FOREIGN PATENT DOCUMENTS

| | | | |
|---|---|---|---|
| DE | 20 2009 002852 | U1 | 6/2009 |
| EP | 1 003 194 | A1 | 5/2000 |
| EP | 1 187 288 | A2 | 3/2002 |
| EP | 1 258 838 | A2 | 11/2002 |
| JP | 2007-531211 | A | 11/2007 |
| KR | 10-2018-0006178 | | 1/2018 |

OTHER PUBLICATIONS

International Searching Authority/EP, International Search Report and Written Opinion of the International Searching Authority, Application No. PCT/EP2020/050364, dated Apr. 9, 2020, with English translation of the International Search Report, 15 pages.
International Preliminary Examining Authority/EP, International Preliminary Report on Patentability, Application No. PCT/EP2020/050364, dated May 25, 2021, 13 pages (in German).
German Patent Office, Office Action, Application No. 10 2019 102 792.6, dated Nov. 8, 2019, 7 pages (in German).

* cited by examiner

FUSIBLE LINK, CIRCUIT ARRANGEMENT AND MOTOR VEHICLE COMPRISING SAID CIRCUIT ARRANGEMENT

CROSS-REFERENCE TO RELATED APPLICATIONS

This application is the national phase entry of international patent application no. PCT/EP2020/050364 filed Jan. 21, 2020 and claims the benefit of German patent application No. 10 2019 102 792.6, filed Feb. 5, 2019, the disclosures of which are incorporated herein by reference in their entirety.

TECHNICAL FIELD

The subject matter relates to a melting fuse and a circuit arrangement with a melting fuse. Furthermore, the subject matter relates to the use of such a melting fuse as well as a circuit arrangement in automotive applications, in particular a motor vehicle with such a circuit arrangement.

BACKGROUND ART

Conventional melting fuses, known as plug-in fuses, are nowadays also used in safety-relevant applications of motor vehicles as line protection. Blade fuses and miniature blade fuses are used in particular in automotive applications. In these fuses, a melting wire is contacted via two flat terminal lugs. The flat terminal lugs are clamped in a terminal housing (fuse box) and can be removed and replaced with little effort.

The problem with blade fuses as well as with other melting fuses is the lack of diagnostic capability. However, the ever-increasing complexity of electronic components in vehicles also increases the probability of malfunctions. If a safety-relevant component is affected, a malfunction can have devastating consequences, in particular people can be harmed. The ISO standard ISO26262 establishes guidelines for the functional safety of electrical and electronic components in motor vehicles. In order to comply with these, monitoring at the components is necessary, but this is not possible with conventional melting fuses.

The subject matter was therefore based on the object of optimizing the monitoring of melting fuses.

SUMMARY OF THE INVENTION

The melting fuse according to the subject matter has a melting wire between a first and a second terminal. The construction of melting fuses per se is known. The melting wire is adjusted in its wire cross-section and its conductivity so that it melts at a certain amperage and thus separates an electrical path between the two terminals. The mode of operation of a melting wire in a melting fuse is also known per se, so that a detailed description is dispensed with.

It has now been recognized that monitoring the melting wire in conventional melting fuses is problematic. In order to enable monitoring of the melting wire, it is proposed that a connection pin is arranged on each of the first and second terminals. A connection pin is an electrical conductor that protrudes away from the terminals. A printed circuit board is placed on the connection pins. Preferably, the printed circuit board is soldered to the connection pins. An integrated circuit is arranged on the printed circuit board itself, with which an evaluation of measured values detected at the melting wire can be carried out. In particular, the integrated circuit has an A/D converter. Furthermore, sensors can be arranged on the circuit board with which physical variables can be tapped at the melting fuse, in particular the melting wire. For example, current, voltage and temperature sensors can be provided. Analog output signals from such sensors can be digitized by means of the A/D converter and then further processed on a microcontroller. The microcontroller can also be arranged on the printed circuit board.

The present melting fuse makes it possible to add monitoring functions to a conventional setup.

The present melting fuse makes it possible to detect faults on the melting fuse. It is also possible to determine before a fault occurs that a fault is likely to occur. By comparing the measured data with comparative data, it is possible to determine by how much a measured value deviates from a nominal value. A deviation can be interpreted as an indication of a possible error in the future. Such monitoring of components is also known as preemptive maintenance.

According to an embodiment, it is proposed that the printed circuit board is placed on the connection pins with vias. The printed circuit board has vias (holes) that are connected to conductive tracks on one or both sides of the printed circuit board. The printed circuit board is attached to the connection pins with the vias. A connection pin can be connected, in particular soldered, to the printed circuit board directly at to the via at which a solder contact of the conductive tracks can be provided.

According to an embodiment, it is proposed that the integrated circuit comprises at least one microcontroller. The microcontroller is used for processing the preferably digital measurement data. With the aid of the microcontroller, it is possible to perform an evaluation of the measured data directly at the melting fuse and, if necessary, to output an error signal in the event of an error or to output a warning signal in the event of a deviation of one or more measured values from certain limit values.

According to an embodiment, it is proposed that an insulation layer is arranged between the melting wire and the printed circuit board. Via this insulation layer, contacting of the printed circuit board with the terminals and/or the melting wire is prevented.

According to an embodiment, it is proposed that the connection pins and the melting wire are arranged in a U-shape with respect to each other. The bottom of the U may be formed by the melting wire. The two legs may be formed by the connection pins. Thus, the connection pins may be formed protruding from the melting wire. The printed circuit board may be located between the two legs.

Conventional fuse boxes allow melting fuses to be plugged in and thus make it particularly easy to replace the melting fuse. If a printed circuit board is now additionally arranged on the melting fuse on the side facing away from the terminals via the connection pins projecting from the melting wire, it can be inserted into conventional melting fuse boxes.

The integrated circuit, in particular the microcontroller, can output control signals or error signals by wire or wirelessly. Depending on an evaluation of the measurement signals, the integrated circuit, in particular the microcontroller can generate an output signal, which can be output wired or wirelessly. It is also possible for the integrated circuit, in particular the microcontroller, to couple a control signal to the terminals via the connection pins, which can be transmitted to a central control device via the on-board network. In such a case, the melting fuse does not require any further contacting to enable processing of the measurement signals.

The integrated circuit can be electrically powered via the connection pins. A voltage drop across the melting wire, which may be as low as a few mV, may be sufficient to electrically operate the integrated circuit.

According to an embodiment, it is proposed that the first and second terminals extend along a longitudinal axis. The longitudinal axes of the terminals preferably extend substantially parallel to each other. The melting wire preferably extends substantially perpendicular to the longitudinal axes of the terminals. The melting wire and the terminals span a plane, and the connection pins may extend in this plane or substantially perpendicular to this plane. In particular, the connection pins are parallel to the respective longitudinal axes of the respective terminals.

According to an embodiment, it is proposed that the terminals are formed as flat tabs and/or that the connection pins are formed wire-shaped. In particular, the connection pins are formed wire-shaped round. This simplifies the assembly with printed circuit boards, since these are prepared for round, wire-shaped connection pins.

According to an embodiment, it is proposed that the respective terminals and connection pins are formed in one piece. In a stamping-pressing process, it is possible to stamp connection pins together with terminals. It is also possible to press the terminals from a wire. It is also possible that the connection pins are soldered or welded to the terminals.

According to an embodiment, it is proposed that the terminals and the melting wire are arranged on a substrate, that the connection pins protrude from the substrate, and that the printed circuit board is a component separate from the substrate, but may also abut the substrate. Preferably, the terminals and the melting wire are arranged in a common housing. In particular, they are cast there. The connection pins are guided out of the housing. On the bottom side of the housing, spaced from one another, the terminals can project out of the housing. In particular, the terminals can be formed as flat blades, as is the case with conventional flat blade fuses. On the lid side of the housing, i.e. opposite the base, the printed circuit board can be placed directly on the housing. The connection pins may protrude from the lid of the housing and the printed circuit board may be placed on the lid. In particular, the printed circuit board is dimensioned such that its area is congruent with the cross-sectional area of the housing parallel to the lid area of the housing. In particular, the printed circuit board is congruent with the lid surface of the housing. This makes it possible to insert melting fuses according to the subject matter into conventional fuse holders without having to change their form factor. The bottom and/or lid of the housing can also be any other side walls of the housing.

According to an embodiment, it is proposed that a voltage and/or a current can be sensed on the printed circuit board via the connection pins across the melting wire and/or a temperature can be sensed at the melting wire. A voltage can be measured directly between the connection pins. A current can be measured either via a measuring resistor or, for example, contactlessly via a Hall sensor or the like. Also, the current across the melting fuse can be determined from the known resistance value of the melting fuse and the voltage tapped across it. A temperature can be detected via a temperature sensor. In particular, the temperature sensor is on the surface of the printed circuit board facing the melting wire side. Also, the temperature sensor may be located on the printed circuit board and determine the temperature at a connection pin. Knowing the conductivity of the connection pin and the distance to the melting wire, a temperature of the melting wire can be derived therefrom. The current sensor and/or the voltage sensor can be arranged on the side of the printed circuit board facing away from the melting wire. Measurement signals from the sensors are preferably analog signals, which can first be converted into digital signals by means of an A/D converter and then processed in an integrated circuit, in particular a microcontroller, which is in particular also arranged on the printed circuit board.

A further aspect is a circuit arrangement comprising a previously described melting fuse. Such a circuit arrangement is arranged in particular in a motor vehicle and serves to connect a battery to a load. In the current path between the battery and the load, the melting fuse may be arranged, in particular in a fuse box. During operation, the operating current flows via the melting fuse. If a fault occurs on the part of the load, the current exceeds a limit value and the melting wire melts, so that the connection between the battery and the load is disconnected. A heating up of the melting wire as well as an interruption of the melting wire can be detected via the circuit arrangement, in particular the sensors on the printed circuit board. Also, an increase in a current and/or a temperature can be detected even before melting and, if necessary, preventive measures can be taken.

BRIEF DESCRIPTION OF THE DRAWINGS

The subject matter is explained in more detail below with reference to a drawing showing embodiments. The drawings show in.

DETAILED DESCRIPTION OF SPECIFIC EMBODIMENTS

Figure 1:
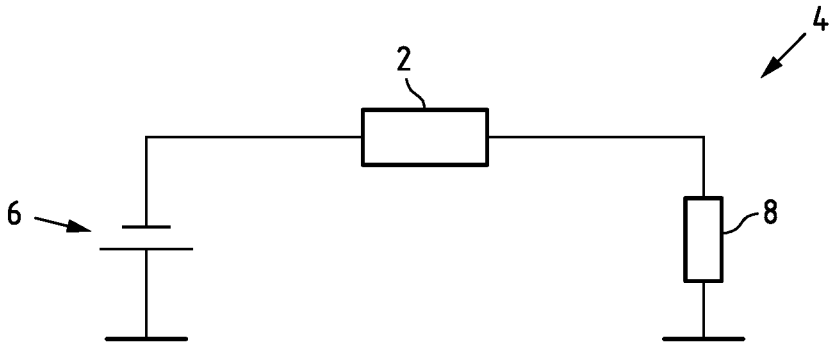
FIG. 1 a circuit arrangement of a melting fuse.

FIG. 1 shows a melting fuse 2 in an on-board power supply system 4 of a motor vehicle.

The melting fuse 2 is arranged between a battery 6 and a load 8. The battery 6 can be either a battery for conventional loads or a traction battery. The loads 8 may be safety-critical loads, such as steering power assistance, braking power assistance, ESP, airbag control, and the like. Also, the load 8 may be a powertrain. The circuit arrangement 2 is arranged between the battery 6 and the load 8.

Figure 2:
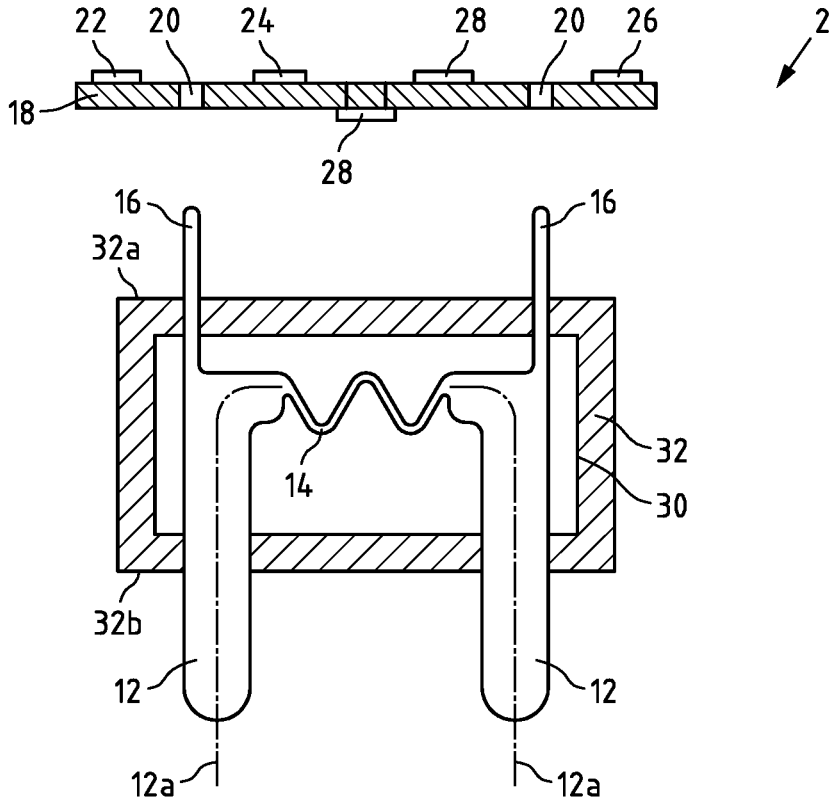
FIG. 2 a cross-sectional view of a melting fuse assembly.

A melting fuse 2 is described in more detail in FIG. 2. The melting fuse 2 has two terminals 12, which are preferably formed as flat plugs and which lie in a plane with respect to one another. The terminals 12 are electrically connected to each other via a melting wire 14. The conductivity of the melting wire 14 is reduced compared to the conductivity of the terminals 12. This can be achieved by a suitable choice of material and/or a suitable reduction in cross-section. Due to the reduction in conductivity, the melting wire 14 melts in the event of an overcurrent, which is in itself sufficiently well known.

Starting from the terminals 12, a respective connection pin 16 extends parallel to the respective longitudinal axis 12*a* of the terminals 12. The connection pins 16 may be arranged integrally on the terminals 12 or attached thereto, in particular welded or soldered.

The connection pins 16 are spaced apart from one another. At a same spacing, a printed circuit board 18 has through-holes, so-called vias 20. The printed circuit board 18 can be plugged onto the connection pins 16 with the vias 20. On the printed circuit board 18 are conductor tracks (not shown) arranged in a conventional manner, via which discrete components 22, microcontrollers 24, A/D converters 26 as well as measuring sensors 28*a, b* can be interconnected.

For example, a temperature sensor 28*a* may be arranged on a side of the printed circuit board 18 facing the melting wire 14. A voltage and/or current sensor 28*b* may be arranged on the opposite side. In operation, the printed circuit board 18 with its components 22-28 is electrically contacted with the terminals 12 via the connection pins 16. A voltage as well as a current across the melting wire 14 can be measured with corresponding current/voltage sensors 28*b*. A temperature across the melting wire 14 can be measured using the sensor 28*a*.

Measured values can be in analog form, which can be converted by the A/D converter 26 and then processed further by the microcontroller 24.

The melting fuse 2 is preferably constructed in such a way that parts of the terminals 12, the melting wire 14 and preferably also parts of the connection pins 16 are applied to a substrate 30. The substrate 30 can, for example, be a non-conductive layer, for example a so-called prepreg.

The melting fuse 2 has a housing 32 which encloses parts of the terminals 12, parts of the connection pins 16, the melting wire 14 and the substrate 30. The housing 32 has a housing lid 32*a* and a housing base 32*b*. The housing may be sealed, and the lid 32*a* and base 32*b* may be integral parts of the housing 32 and not removable from the housing 32. In particular, the housing 32 cannot be opened.

On the side of the bottom 32 of the housing, the terminals 12 protrude from the housing 32. On the opposite side, at the housing lid 32*a* the connection pins 16 protrude from the housing 32.

Figure 3:
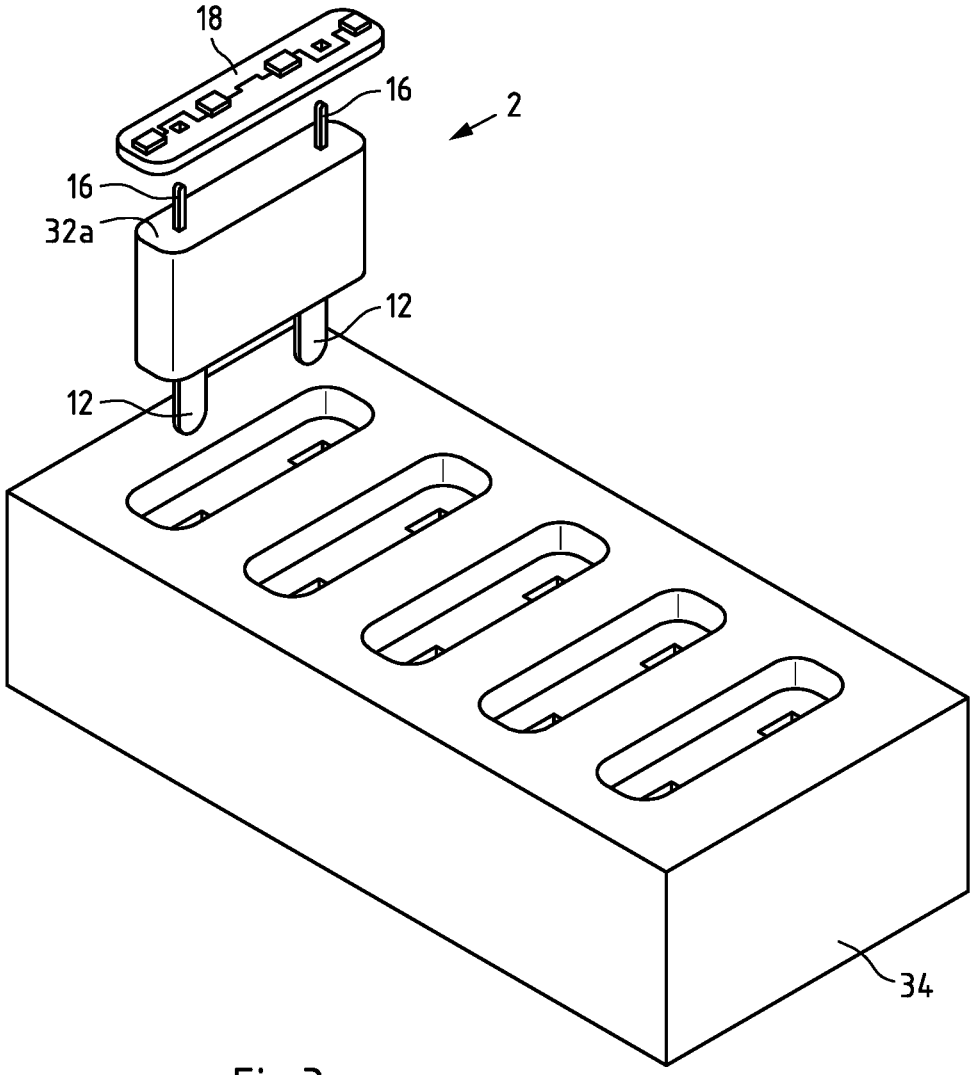
FIG. 3 the installation of a melting fuse in a fuse holder.

In particular, the melting fuse 2 is formed as a blade fuse so that it can be used in a conventional application as shown in FIG. 3.

FIG. 3 shows an exploded view, in which a fuse box 34 is shown. A melting fuse 2 can be electrically plugged into the fuse box 34 with its connection pins 12. On the side of the housing lid 32*a*, the connection pins 16 protrude from the housing 32. The printed circuit board 18 can be plugged onto the connection pins 16 and electrically contacted with the connection pins 16. The circuit board 18 may have a form factor such that its footprint is substantially congruent with the footprint of the housing lid 32*a*. Thus, the circuit board 18 will not interfere when the melting fuse 32 is inserted into a conventional fuse box 34.

REFERENCE SIGNS

2 Melting Fuse
4 On-board Power Supply
6 Battery
8 Load
12 Terminal
12*a* Longitudinal Axis
14 Melting wire
16 Connection Pin
18 Printed Circuit Board
20 Vias
22 Discrete Components
24 Microcontroller
26 A/D converter
28 Measuring Sensors
28*a* Temperature Sensor
28*b* Current/Voltage Sensor
30 Substrate
32 Housing
32*a* Housing Lid
32*b* Housing Base
34 Fuse Box

What is claimed is:

1. Melting fuse comprising:

a melting wire arranged between a first and a second terminal;

a connection pin arranged on each of the first and second terminals;

a printed circuit board placed on the connection pins; and at least one integrated circuit arranged on the printed circuit board on the side facing away from the melting wire, wherein the at least one integrated circuit comprises at least one microcontroller, and the at least one integrated circuit is electrically powered via the connection pins, wherein the integrated circuit is operated by a voltage drop across the melting wire.

2. Melting fuse according to claim 1, wherein the printed circuit board is placed on the connection pins with vias.

3. Melting fuse according to claim 1, wherein an insulation layer is arranged between the melting wire and the printed circuit board.

4. Melting fuse according to claim 1, wherein the connection pins and the melting wire are arranged in a U-shape with respect to each other.

5. Melting fuse according to claim 1, wherein the first and second terminals extend along a longitudinal axis, the longitudinal axes of the terminals are substantially parallel to each other, the melting wire is substantially perpendicular to the longitudinal axes of the terminals, and the connection pins are substantially parallel to the respective longitudinal axes of the respective terminals.

6. Melting fuse according to claim 1, wherein the terminals are formed as flat tabs and the connection pins are formed in the shape of wires.

7. Melting fuse according to claim 1, wherein the respective terminals and connection pins are formed in one piece.

8. Melting fuse according to claim 1, wherein the terminals and the melting wire are arranged on a substrate, the connection pins protrude from the substrate, and the printed circuit board is separated from the substrate.

9. Melting fuse according to claim 1, wherein the terminals and the melting wire are arranged in a common housing, in particular encapsulated, and the connection pins are guided out of the housing.

10. Melting fuse according to claim 1, wherein a voltage and/or a current via the melting wire and/or a temperature at the melting wire can be tapped on the printed circuit board via the connection pins.

11. Circuit arrangement including a melting fuse according to claim 1, a battery and at least one load, the battery being electrically connected to the melting fuse via the first terminal, and the load being connected to the melting fuse via the second terminal.

12. Motor vehicle comprising a circuit arrangement according to claim 11.

* * * * *